United States Patent [19]

DeHart

[11] 3,968,485

[45] July 6, 1976

[54] BURGLAR WARNING DEVICE

[76] Inventor: Harry I. DeHart, P.O. Box 508, Radford, Va. 24141

[22] Filed: July 2, 1975

[21] Appl. No.: 572,412

[52] U.S. Cl. ..... 340/274 R; 116/86; 200/61.93

[51] Int. Cl.[2] ..... G08B 13/08

[58] Field of Search ..... 340/274 R, 283; 116/86, 116/7, 5; 200/61.93, 61.62

[56] References Cited

UNITED STATES PATENTS

| | | | |
|---|---|---|---|
| 676,744 | 6/1901 | Gatten | 340/274 |
| 886,355 | 5/1908 | Dawson | 340/283 |
| 991,219 | 5/1911 | Maynard | 340/274 |
| 1,242,547 | 10/1917 | Harrington | 116/7 |
| 1,464,788 | 8/1923 | Wakefield, Sr. | 200/61.62 |
| 2,636,091 | 4/1953 | Carter | 340/274 |

*Primary Examiner*—Glen R. Swann, III

[57] ABSTRACT

A twine or cord is stretched across an entrance and secured at one end to one side of the entrance and at the other end linked loosely to an electric light switch near the other side of the entrance so that upon opening the entrance by way of a door by burglar or intruder the switch is activated by a pull on the cord, and thence the switch, and thereafter the link slips off the switch to prevent breakage of the cord.

5 Claims, 5 Drawing Figures

BURGLAR WARNING DEVICE

SUMMARY OF THE INVENTION

My invention is a burglar warning device which operates by activating electric light switches in a dwelling upon opening of a door or other entrance way.

The device makes use of the fact that many entrances open into a dwelling or other structure and that light control switches are usually located adjacent to the entrance way. There are no devices now available, to my knowledge, which provide a burglar alarm at an economical price. My device, when installed, will activate light control switches, thereby providing both a deterrant to intruders and an alarm to occupants.

In the device of my invention a cord or line is stretched across a doorway or other opening of an office or dwelling so that it is pushed aside upon opening of the door by an intruder. One end of the cord is secured to the door hinge or other fixed point. The other end of the cord is linked to an electric light switch mounted adjacent to the door opening. The device conveniently employs a plastic ring or loop which is slipped onto the switch control in setting device. And conveniently the cord running across the doorway is brought over a hook fixed to the facing of the door opening in order that the cord brings to bear a direct and upward pull upon the switch control.

Upon actuation by opening the door the switch control is snapped upward and the house lights are lit following which the ring or loop slips off the switch control to prevent cord breakage.

DESCRIPTION OF THE DRAWINGS

In the accompanying drawings, illustrating a preferred embodiment of my invention.

DESCRIPTION OF THE PREFERRED EMBODIMENT

Figure 1:
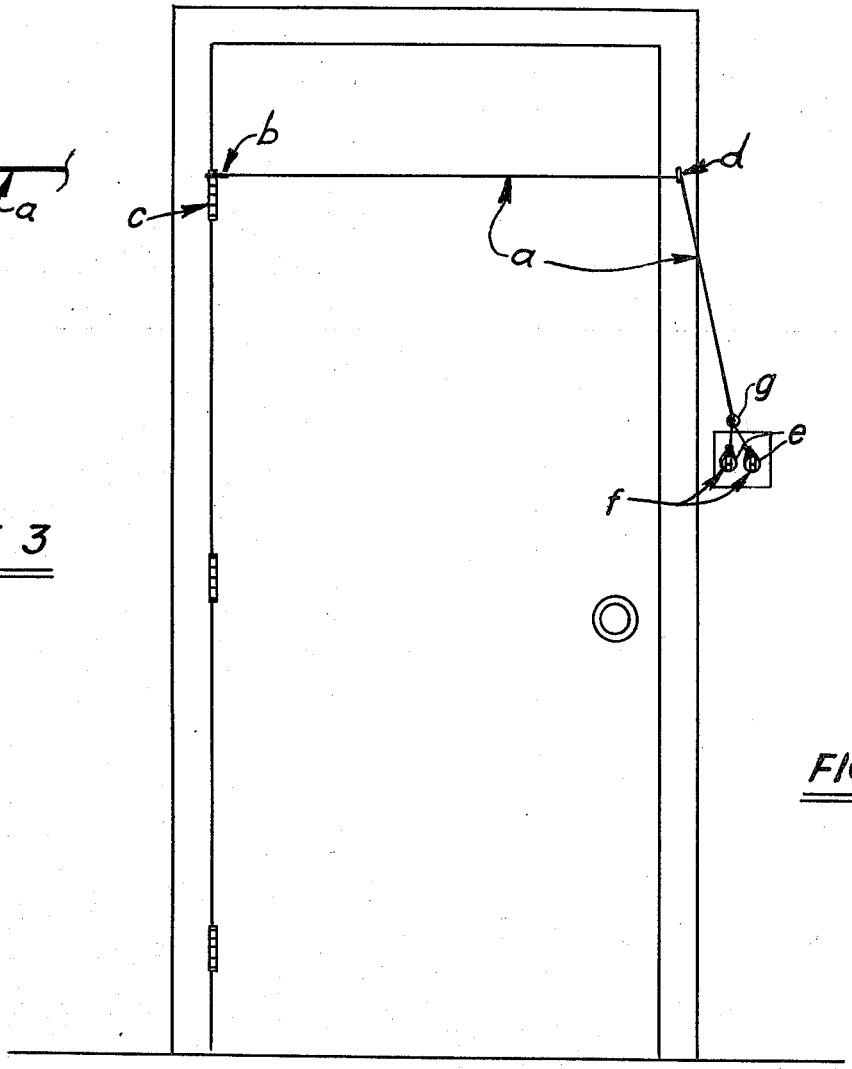
FIG. 1 is a vertical front view of the device as installed across a doorway.
Figure 4:
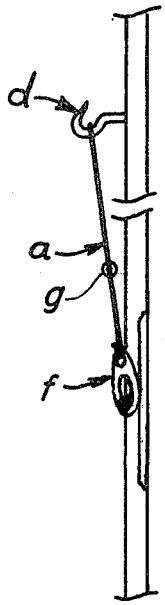
FIG. 4 is a detached side view on enlarged scale of the installed device of FIG. 1, this showing the other end of the device passing over a hook and linked to an electric light switch adjacent to the doorway.

Referring now more particularly to the practice to my invention and directing attention to the drawings, FIG. 1 is a typical view of the device of my invention as installed on a door entrance way. Letter *a* shows a length or cord or twine as properly adjusted to fit the entrance way, with the cord or line adjusted at the flat ring *b* secured on the door hinge at *c*. The cord is passed over a ¼ inch cup screw hood *d* and then on to the light control switch *e*. Flat rings *f*, *f* are connected to cord *a* by way of short cord sections and a single ring *g*. The placement of my device with the light control switch on a down or off position is shown in FIGS. 1 and 4.

Figure 3:
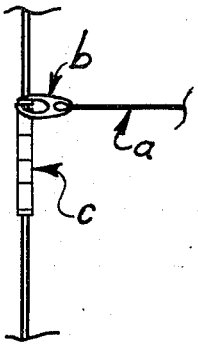
FIG. 3 is a detached view also on enlarged scale of one end of the device as secured to the top hinge of the door shown in FIG. 1.

Installation of the device of my invention with a flat ring *b* on the door hinge *c* and the cord *a* free for adjustment is shown in FIG. 3 of the drawing. It is to be noted that the cord *a* of the installed device passes across the entrance way and to the light control switches with the flat rings *f*, *f* properly hooked underneath the light control switches. Operation of the switches is assured by the upward pull had by cord *a* running over the hook at *d*.

Figure 2:
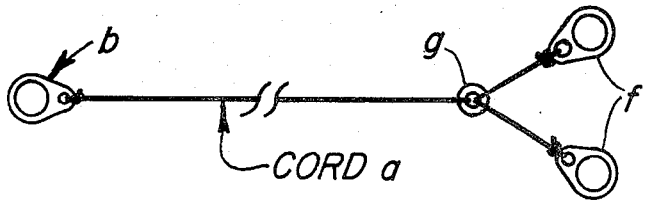
FIG. 2 is a detached view of the device of FIG. 1, this on enlarged scale.
Figure 5:
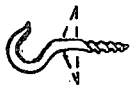
FIG. 5 is a detached view on enlarged scale of the hook shown in the views of FIGS. 1 and 4.

The several parts of the device of my invention are shown in FIG. 2. They include: Three sections of cord or twine, two of which are say 10 inches in length for attachment of flat rings *f* to single ring *g*, and a third section *a* of say 6 feet in length secured to ring *b* for attachment to door hinge *c* with one end to be secured to one end of the 10 inch sections of cord by way of ring *g*. One end of section *a* remains free for adjustment on flat ring *b* or *g* for installation as heretofore described. The three rings *b* and *f*, *f* conveniently are fashioned of three-thirtyseconds inch nylon made from flat sheet stock, each containing apperatures of three-sixteenths and one-sixteenth inch in diameter. Cord or line *a* conveniently is looped over a standard ¼ inch screw hook *d* secured to the door facing as shown in FIGS. 1 and 4.

Thus it will be seen that I provide in my invention a burglar device designed to both frighten intruders and to alert occupants of the dwelling or other building, such device being designed to activate light control switches adjacent to the entrance way, and as a result, the lights of the dwelling or other building upon any opening of the entrance way.

The device of my invention is subject to wide variation as to details of construction. It is primarily a device which is made from simple materials. Other forms of suitable apparatus are conceivable, other than those illustratively shown in several figures of the drawings, that is with a single line *f* actuating a single light switch.

Having described my invention so that one skilled in the art can produce it, I claim:

1. A burglar warning device to be installed across a doorway or the like and activated by the opening of the door comprising in combination a cord or line to be stretched across the doorway, means at one end of the cord for securing to a fixed position on said doorway, means at the other end for loosely engaging a light control switch, and means for directing the line in a vertically downward direction to assure an upward pull on said switch.

2. Warning device according to claim 1 wherein the said means at said other end of the cord comprises a ring engaging the said switch.

3. Warning device according to claim 1 wherein the means at said other end of the cord comprises a ring connected to said cord and to a short length of cord connected to a pair of rings for engaging a pair of light switches.

4. Warning device according to claim 1 wherein said means for directing a cord in a vertically downward direction comprises a screw hook engaging a door facing.

5. Warning device according to claim 1 wherein the door is provided with a hinge and wherein the means at the one end of the cord comprises a ring for engaging said hinge.

* * * * *